US009617943B2

(12) United States Patent
Ide et al.

(10) Patent No.: US 9,617,943 B2
(45) Date of Patent: Apr. 11, 2017

(54) CONTROL APPARATUS FOR AN ENGINE

(71) Applicant: MITSUBISHI JIDOSHA KOGYO KABUSHIKI KAISHA, Tokyo (JP)

(72) Inventors: Hideto Ide, Tokyo (JP); Katsunori Ueda, Tokyo (JP); Toshiyuki Miyata, Tokyo (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 626 days.

(21) Appl. No.: 13/848,999

(22) Filed: Mar. 22, 2013

(65) Prior Publication Data

US 2014/0005912 A1 Jan. 2, 2014

(30) Foreign Application Priority Data

Jun. 29, 2012 (JP) ..... 2012-146246

(51) Int. Cl.
*F02D 41/00* (2006.01)
*F02D 41/30* (2006.01)
*F02D 41/14* (2006.01)

(52) U.S. Cl.
CPC ..... *F02D 41/3005* (2013.01); *F02D 41/0042* (2013.01); *F02D 41/0045* (2013.01); *F02D 41/1454* (2013.01)

(58) Field of Classification Search
CPC ..... F02D 41/0045; F02D 41/0042
(Continued)

(56) References Cited

U.S. PATENT DOCUMENTS 5,150,686 A * 9/1992 Okawa ..... F02D 41/0032 123/520
5,529,047 A * 6/1996 Aota ..... F02D 41/004 123/674

(Continued)

FOREIGN PATENT DOCUMENTS

JP S 56-133658 A * 10/1981
JP 7-63078 A 3/1995

(Continued)

*Primary Examiner* — Hung Q Nguyen
*Assistant Examiner* — Josh Campbell
(74) *Attorney, Agent, or Firm* — Birch, Stewart, Kolasch & Birch, LLP

(57) ABSTRACT

A control apparatus for an engine introduces purge gas containing fuel gas evaporated from a fuel tank into an intake system includes an air-fuel ratio calculation unit that calculates an air-fuel ratio (AF) of the engine, and a purge rate calculation unit that calculates a purge rate ($R_{PRG}$) corresponding to an introduction rate of the purge gas. The control apparatus further includes a concentration calculation unit that calculates a concentration ($K_{AF_PRG}$) of the purge gas based on the air-fuel ratio (AF) calculated by the air-fuel ratio calculation unit and the purge rate ($R_{PRG}$) calculated by the purge rate calculation unit. A decision unit permits or inhibits the concentration calculation unit to calculate the concentration ($K_{AF_PRG}$) based on the purge rate ($R_{PRG}$) calculated by the purge rate calculation unit. The estimation accuracy of the concentration ($K_{AF_PRG}$) of purge gas is improved.

11 Claims, 4 Drawing Sheets

(58) Field of Classification Search
USPC ..... 701/103–104; 123/698
See application file for complete search history.

(56) References Cited

U.S. PATENT DOCUMENTS

| | | | | |
|---|---|---|---|---|
| 7,171,960 | B1 | 2/2007 | Hagari | |
| 7,996,143 | B2 | 8/2011 | Okazaki | |
| 2003/0200958 | A1* | 10/2003 | Ito et al. | 123/520 |
| 2005/0065708 | A1* | 3/2005 | Hanazaki et al. | 701/109 |
| 2005/0193976 | A1* | 9/2005 | Suzuki | F02B 31/04 123/308 |
| 2007/0277789 | A1* | 12/2007 | Ishikawa | F02D 41/0042 123/520 |
| 2009/0205323 | A1* | 8/2009 | Tsujimoto et al. | 60/286 |
| 2009/0292449 | A1* | 11/2009 | Yamazaki et al. | 701/103 |
| 2010/0235072 | A1* | 9/2010 | Okazaki | F02D 41/0042 701/106 |

FOREIGN PATENT DOCUMENTS

| | | | |
|---|---|---|---|
| JP | 2004-68787 | A | 3/2004 |
| JP | 2007-146739 | A | 6/2007 |
| JP | 2008-303857 | A | 12/2008 |

* cited by examiner

FIG. 2
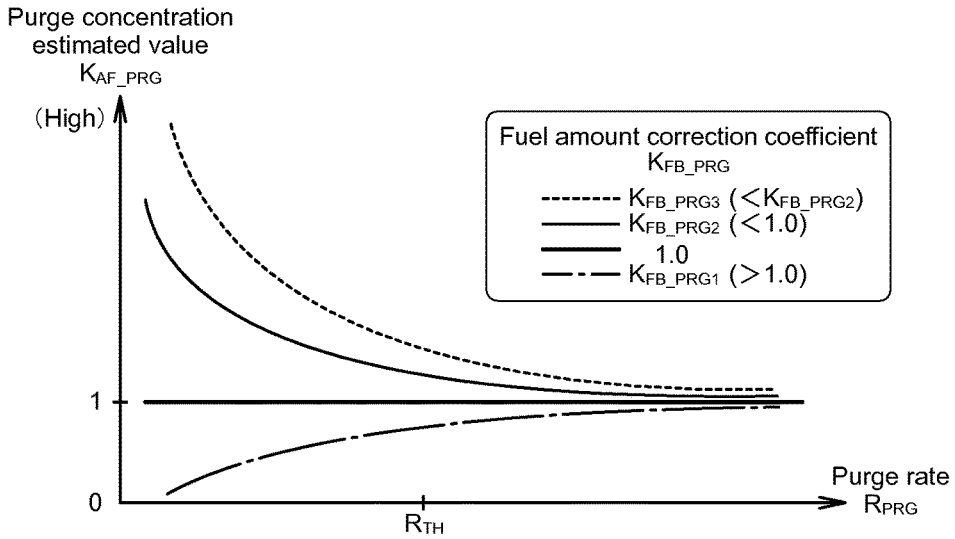
FIG. 3
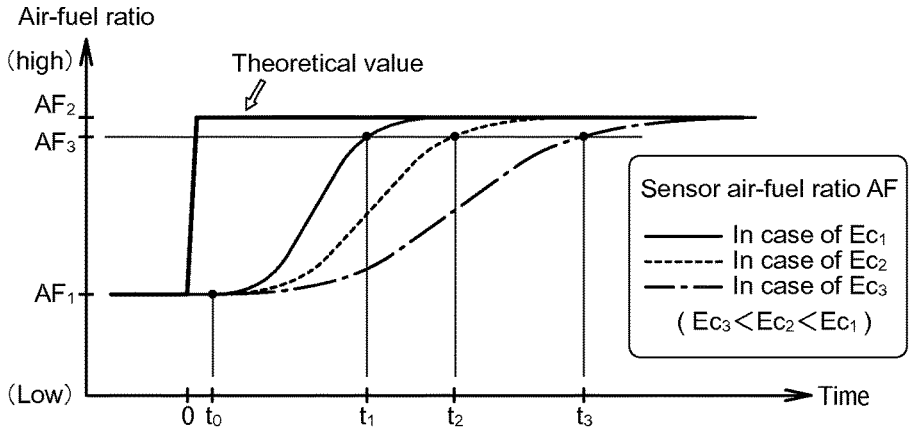
FIG. 4
| Charging efficiency Ec | Stroke number IG | Reciprocal to stroke number |
|---|---|---|
| $Ec_1$ | $IG_1$ | $1 / IG_1$ |
| $Ec_2$ | $IG_2$ | $1 / IG_2$ |
| $Ec_3$ | $IG_3$ | $1 / IG_3$ |
| ⋮ | ⋮ | ⋮ |

CONTROL APPARATUS FOR AN ENGINE

CROSS-REFERENCE TO THE RELATED APPLICATION

This application incorporates by references the subject matter of Application No. 2012-146246 filed in Japan on Jun. 29, 2012 on which a priority claim is based under 35 U.S.C. S119(a).

FIELD

The present invention relates to a control apparatus for an engine that introduces purge gas containing fuel gas evaporated from a fuel tank into an intake system.

BACKGROUND

A technology for preventing leakage of a fuel component to the outside of the vehicle by introducing fuel gas volatilizing in a fuel tank of a vehicle into a cylinder of an engine is known. Fuel gas in the fuel tank is temporarily absorbed by a canister, and fuel gas desorbed from the canister (this is called "purge gas") is introduced into an intake passage. On a purge passage that connects the canister and the intake passage to each other, a purge controlling valve for adjusting the flow rate of the purge gas is disposed, and the opening of the purge controlling value is controlled in response to the operating condition of the engine.

Incidentally, the air-fuel ratio of air-fuel mixture introduced into a cylinder of an engine during introduction of purge gas varies in response to the concentration of the purge gas. Therefore, a technology for controlling the air-fuel ratio appropriately by estimating the concentration of the purge gas with a high degree of accuracy has been developed. For example, a technology of providing an air-fuel ratio sensor on an exhaust passage to detect an air-fuel ratio and estimating the concentration of purge gas based on a difference between the detected air-fuel ratio and a target air-fuel ratio is known. Also a technology of calculating an air-fuel ratio feedback correction coefficient that corresponds to a ratio between an air-fuel ratio and a target air-fuel ratio and learning the concentration of purge gas based on a variation of the correction coefficient is available (for example, Japanese Laid-Open Patent Publication No. Hei 7-63078 (JPA 1995-063078)).

However, according to a concentration calculation technique based on an air-fuel ratio, the calculation error tends to increase as the flow rate of purge gas decreases.

A relationship between an air-fuel ratio detected by an air-fuel ratio sensor on an exhaust passage and a concentration and a purge gas flow rate of purge gas is exemplified as a graph in FIG. 7. This graph particularly indicates a relationship among three factors including the concentration of purge gas, the purge gas flow rate and the air-fuel ratio detected by a sensor when air-fuel mixture of purge gas of an arbitrary air-fuel ratio and fresh air of a stoichimetric air-fuel ratio is supplied into a cylinder. If this relationship is used, then it is possible to estimate the concentration of purge gas from a purge gas flow rate and an air-fuel ratio.

When the value of the air-fuel ratio detected by an air-fuel ratio sensor is equal to a stoichimetric air-fuel ratio, it is estimated that the concentration of the purge gas exhibits the stoichimetric air-fuel ratio irrespective of the magnitude of the flow rate of the purge gas. On the other hand, when the value of the air-fuel ratio detected by the air-fuel ratio sensor is lower (richer) than the stoichimetric air-fuel ratio, the estimated value of the concentration of the purge gas increases as the flow rate of the purge gas decreases. On the contrary, when the value of the air-fuel ratio is higher (leaner) than the stoichimetric air-fuel ratio, the estimated value of the concentration of the purge gas decreases as the flow rate of the purge gas decreases.

As described above, as the flow rate of purge gas decreases, the estimated value of the concentration of the purge gas fluctuates by an increasing amount with respect to a small variation of the value of the air-fuel ratio. Accordingly, in an operating condition in which the opening of the purge controlling valve is controlled to a comparatively low value, the estimation accuracy of the concentration of purge gas is apt to degrade, and the controllability of the engine may degrade.

It is to be noted that, if the calculation accuracy of the air-fuel ratio can be enhanced, then also the estimation accuracy of the concentration of purge gas enhances. However, it is difficult to prevent occurrence of a detection error by a dispersion of the detection accuracy caused by an individual difference of an air-fuel ratio sensor or by a time-dependent degradation. Therefore, there is a situation that, for a control apparatus for an engine incorporated in a vehicle on the market, a controlling technique for implementing concentration calculation of purge gas that is not influenced by the calculation accuracy of the air-fuel ratio is sought.

SUMMARY

Technical Problems

The present invention has been made in view of such subjects as described above, and it is one of objects of the present invention to provide a control apparatus for an engine which improves the estimation accuracy of the concentration of purge gas.

It is to be noted that, in addition to the object just described, it can be positioned as another object of the present invention to achieve a working-effect that is derived from configurations indicated by an embodiment of the present invention hereinafter described but cannot be achieved by the prior art.

Solution to Problems (1) The control apparatus disclosed herein is a control apparatus for an engine that introduces purge gas containing fuel gas evaporated from a fuel tank into an intake system, the control apparatus including an air-fuel ratio calculation unit that calculates an air-fuel ratio of the engine, and a purge rate calculation unit that calculates a purge rate corresponding to an introduction rate of the purge gas.

The control apparatus further includes a concentration calculation unit that calculates a concentration of the purge gas based on the air-fuel ratio calculated by the air-fuel ratio calculation unit and the purge rate calculated by the purge rate calculation unit. Furthermore, the control apparatus includes a decision unit that permits or inhibits the concentration calculation unit to calculate the concentration based on the purge rate calculated by the purge rate calculation unit.

(2) Preferably, the decision unit allows the concentration calculation unit to update a calculation value of the concentration to the latest value when the purge rate is equal to or higher than a criterion rate, and the decision unit makes the concentration calculation unit maintain the last value of the concentration when the purge rate is lower than the criterion rate.

(3) Preferably, the control apparatus further includes an air amount calculation unit that calculates an air amount to be introduced into a cylinder of the engine, and an inhibition period calculation unit that calculates a period for which the calculation of the concentration by the concentration calculation unit is inhibited based on a history of the air amount calculated by the air amount calculation unit.

Generally, the exhaust response delay time period varies in response to the air amount described above. This exhaust response delay time period corresponds to a delay time period until a flow rate variation or a concentration variation of purge gas comes to have an influence on the air-fuel ratio. The inhibition period calculation unit controls the period, for which the calculation of the concentration is inhibited, based on a history of the delay time period corresponding to the air-fuel amount. It is to be noted that preferably the period described above is extended or shortened in response to the history of the air amount. Further, preferably the period described above is set taking a intake delay, the combustion delay, and a exhaust delay of air introduced into the cylinder of the engine into consideration.

It is to be noted that the "air amount" here includes a volume and a mass of air that is to be introduced (or is introduced) into the cylinder of the engine and parameters corresponding to them and includes, for example, a charging efficiency, a volumetric efficiency and so forth.

(4) Preferably, the decision unit permits or inhibits the calculation of the concentration to the concentration calculation unit based on a fuel amount correction coefficient correlative to a difference between the air-fuel ratio calculated by the air-fuel ratio calculation unit and a target air-fuel ratio.

(5) In this instance, preferably the decision unit inhibits the calculation of the concentration in a driving state in which the variation amount of the fuel amount correction coefficient is equal to or greater than a criterion amount, and permits the calculation of the concentration in another driving state in which the variation amount of the fuel amount correction coefficient is smaller than the criterion amount.

The "driving state in which the variation amount of the fuel amount correction coefficient is equal to or greater than a criterion amount" here signifies a driving state of the engine in which the fuel amount correction coefficient is apt to vary suddenly and is, for example, a driving state in which the air-fuel ratio calculated by the air-fuel ratio calculation unit and the target air-fuel ratio are apt to become different by a great amount from each other.

(6) More particularly, preferably the decision unit inhibits the calculation of the concentration when the engine is accelerated or decelerated suddenly, and permits the calculation of the concentration except a case in which the engine is accelerated or decelerated suddenly. The "when the engine is accelerated or decelerated suddenly" here signifies when rotational motion of the engine is varying suddenly (when rotational motion of the engine is in a state in which it is varying suddenly). For example, preferably the calculation of the concentration is inhibited when an absolute value of an angular acceleration or deceleration of the engine is equal to or higher than a criterion value, and the calculation of the concentration is made carry out when the angular acceleration or deceleration is lower than the criterion value.

(7) Or, preferably the decision unit inhibits the calculation of the concentration when a load acting on the engine is equal to or lower than a criterion amount, and permits the calculation of the concentration when the load is higher than the criterion amount. The "when a load acting on the engine is equal to or lower than a criterion amount" includes, for example, time at which the torque generated by the engine is in a combustion limit state in which it is in the negative.

(8) Further, preferably the decision unit permits the calculation of the concentration when feedback injection control is being carried out, and inhibits the calculation of the concentration when open loop injection control is being carried out.

The feedback injection control is control of correcting the fuel injection amount to increase or decrease using a detection value of an air-fuel ratio sensor provided in the exhaust system. In this control, the fuel injection amount is corrected so that, for example, stoichiometric combustion (combustion in which the air-fuel ratio is in the proximity of a stoichimetric air-fuel ratio) may be implemented in the cylinder. On the other hand, the open loop injection control is control in which correction using the detection value of the air-fuel ratio sensor is not carried out.

(9) Preferably, the decision unit changes a condition for permitting or inhibiting the calculation of the concentration in response to the air-fuel ratio.

Advantageous Effects

With the control apparatus for an engine disclosed herein, by deciding whether or not concentration calculation of purge gas is to be carried out based on a purge rate, increase of a calculation error of the purge gas concentration can be prevented. Consequently, the engine can be controlled using a purge gas concentration of high estimation accuracy, and the controllability of the air-fuel ratio can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 2 is a graph exemplifying a relationship between the purge gas concentration and the purge rate estimated by the control apparatus;

FIG. 3 is a graph illustrating an exhaust response delay of the engine to which the control apparatus is applied;

FIG. 4 is a table exemplifying data utilized when the period for which estimation calculation of the purge gas concentration is inhibited is controlled by the control apparatus;

DESCRIPTION OF EMBODIMENTS

A control apparatus for an engine is described with reference to the drawings. It is to be noted that an embodiment described below is merely illustrative to the end and it is not intended to exclude various modifications and technical applications that are not demonstrated in the embodiment described below. The configuration of the embodiment can be carried out in various modified forms without departing from the subject matter of them and can be selectively applied as occasion demands or can be combined suitably.

[1. Apparatus Configuration]

[1-1. Engine]

Figure 1:
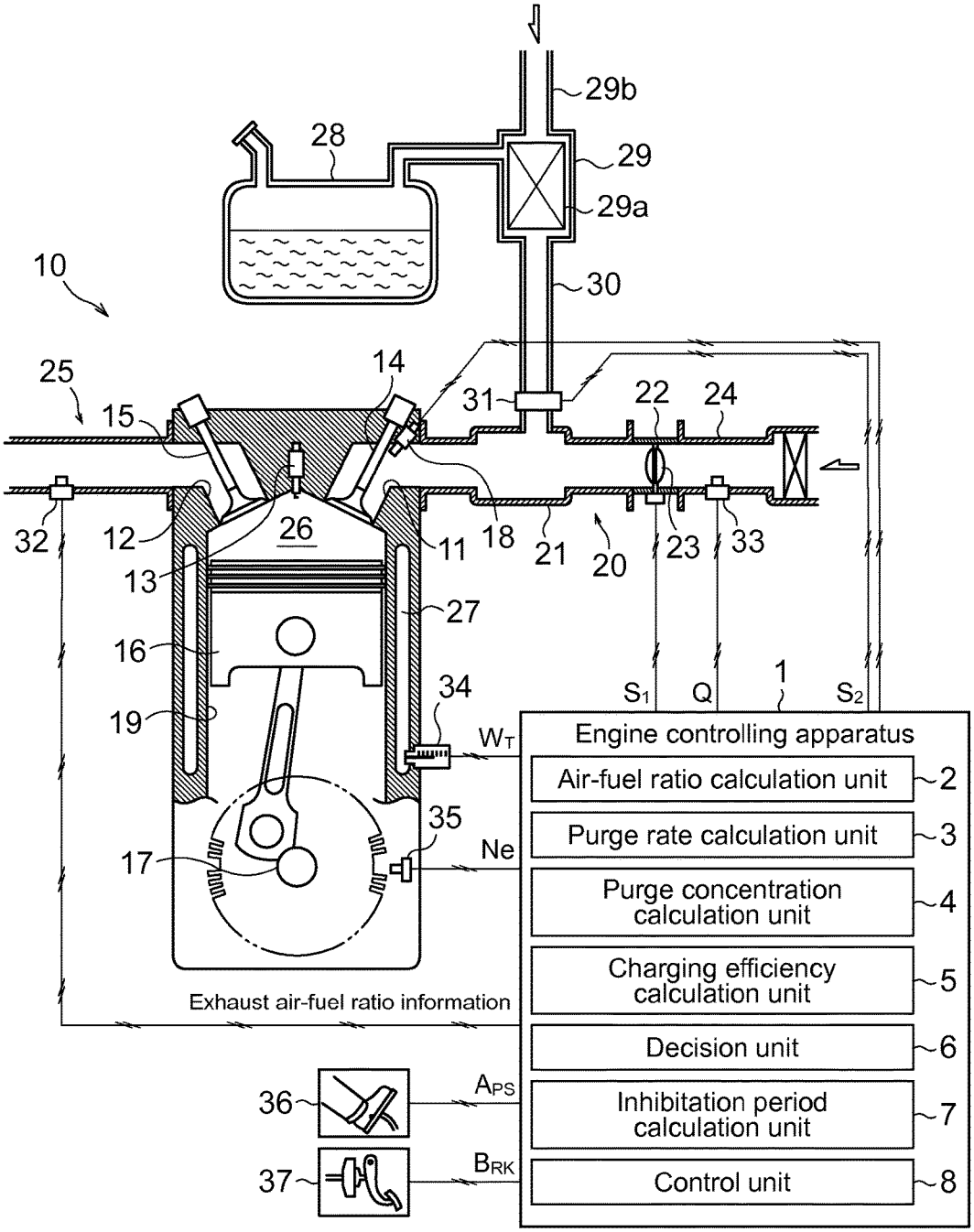
FIG. 1 is a view exemplifying a block configuration of a control apparatus for an engine according to an embodiment and a configuration of an engine to which the control apparatus is applied.

The control apparatus for an engine of the present embodiment is applied to a vehicle-carried gasoline engine 10 depicted in FIG. 1. In FIG. 1, one of a plurality of cylinders provided on the multi-cylinder engine 10 is depicted. A piston 16 is fitted for up-and-down sliding movement along an inner circumferential face of a cylinder 19 formed in a hollow cylindrical shape. A space surrounded by an upper face of the piston 16 and an inner circumferential face and a top face of the cylinder 19 functions as a combustion chamber 26 of the engine.

The piston 16 is connected at a lower portion thereof to a crank arm, which has a center axis eccentric from an axis of a crankshaft 17, through a connecting rod. Consequently, up-and-down movement of the piston 16 is transmitted to the crank arm and converted into rotational movement of the crankshaft 17 by the crank arm.

On the top face of the cylinder 19, an intake port 11 for supplying intake air into the combustion chamber 26 therethrough and an exhaust port 12 for exhausting exhaust gas after combustion in the combustion chamber 26 therethrough are formed as perforations. An intake valve 14 and an exhaust valve 15 are provided at an end portion of the intake port 11 and the exhaust port 12 on the combustion chamber 26 side, respectively. The intake valve 14 and the exhaust valve 15 are controlled for individual operation by a valve mechanism not shown provided at an upper portion of the engine 10. An ignition plug 13 is provided at the top of the cylinder 19 in such a state that an end portion thereof projects toward the combustion chamber 26 side. The ignition timing by the ignition plug 13 is controlled by an engine controlling apparatus 1 hereinafter described.

A water jacket 27 in the inside of which engine cooling water is circulated is provided around the cylinder 19. The engine cooling water is cooling medium for cooling the engine 10 and is circulated in a cooling water circulation passage that annularly connects the water jacket 27 and a radiator to each other.

[1-2. Intake and Exhaust Systems]

An injector 18 for injecting fuel is provided in the intake port 11. The amount of fuel to be injected from the injector 18 is controlled by the engine controlling apparatus 1 hereinafter described. An intake manifold 20 is provided on the upstream side of the intake air flow with respect to the injector 18.

A surge tank 21 for temporarily storing air to flow to the intake port 11 is provided in the intake manifold 20. The intake manifold 20 on the downstream side with respect to the surge tank 21 is formed such that it is branched toward the intake ports 11 of the cylinders 19, and the surge tank 21 is positioned at the branching point. The surge tank 21 functions to moderate intake pulsation or interference which may possibly occur in the cylinders.

A throttle body 22 is connected to the upstream side of the intake manifold 20. An electronically controlled throttle valve 23 is built in the throttle body 22. The air amount to flow to the intake manifold 20 is controlled in response to the opening (throttle opening) of the throttle valve 23. The throttle opening is controlled by the engine controlling apparatus 1.

An intake passage 24 is connected to the further upstream side of the throttle body 22, and an air filter is disposed on the further upstream side of the intake passage 24. Consequently, fresh air filtered by the air filter is s supplied into the cylinders 19 of the engine 10 through the intake passage 24 and the intake manifold 20.

A purge passage 30 for introducing fuel gas desorbed from a canister 29 into the intake system is connected to the surge tank 21. A purge valve 31 of the electromagnetic type for controlling the flow rate of fuel gas (purge gas) purged from the canister 29 into the surge tank 21 is disposed on the purge passage 30. The opening of the purge valve 31 is controlled by the engine controlling apparatus 1.

Activated carbon 29*a* is built in the canister 29. Fuel gas that contains evaporated fuel gas produced in a fuel tank 28 is absorbed and collected by the activated carbon 29*a*. A passage 29*b* for sucking external fresh air is connected to the canister 29. when the purge valve 31 opens, then fresh air is introduced into the canister 29 through the passage 29*b*, and fuel gas desorbed from the activated carbon 29*a* is supplied into the surge tank 21 through the purge passage 30.

An exhaust manifold 25 is provided on the downstream side with respect to the exhaust port 12. The exhaust manifold 25 is formed in a shape in which it joins exhaust gas from the cylinders 19 and is connected to an exhaust passage, an exhaust catalyst apparatus or the like all not shown on the downstream side.

[1-3. Detection System]

An air-fuel ratio sensor 32 for detecting an air-fuel ratio AF of air-fuel mixture burnt in the combustion chamber 26 is provided at an arbitrary position on the downstream side with respect to the exhaust manifold 25. The air-fuel ratio sensor 32 is, for example, an oxygen concentration sensor or an LAFS (linear air-fuel ratio sensor) and detects exhaust gas air-fuel ratio information corresponding to the concentration of oxygen components, fuel components, and so forth contained in exhaust gas.

An air flow sensor 33 for detecting an intake air flow rate Q is provided in the intake passage 24. The intake air flow rate Q is a parameter corresponding to the flow rate of air that passes the throttle valve 23. It is to be noted that an intake air flow from the throttle valve 23 to the cylinder 19 is subject to an intake response delay (delay until air is introduced into the cylinder 19 after it passes the throttle valve 23). Therefore, the flow rate of air introduced into the cylinder 19 at a certain point of time does not necessarily coincide with the flow rate of air that passes the throttle valve 23 at the point of time. Also a flow of purge gas passing the purge valve 31 is subject to an intake response delay similar to the delay that occurs with the intake air flow from the throttle valve 23.

Further, an exhaust air flow from the cylinder 19 to the attachment position of the air-fuel ratio sensor 32 is subject to an exhaust response delay. Therefore, exhaust air-fuel ratio information detected by the air-fuel ratio sensor 32 at a certain point of time corresponds to an air-fuel ratio of that air-fuel mixture obtained by mixing fuel with air that passed the throttle valve 23 in the past (or purge gas that passed the purge valve 31 in the past), and does not necessarily correspond to the intake air flow rate Q or the purge gas flow rate at the point of time. In the present engine controlling apparatus 1, the state of purge gas is decided taking such intake response delay, exhaust response delay and so forth as described above into consideration.

A cooling water temperature sensor 34 for detecting the temperature (cooling water temperature $W_T$) of engine cooling water is provided at an arbitrary position on the water jacket 27 or the cooling water circular passage. Further, an engine speed sensor 35 for detecting the rotational angle of the crankshaft 17 is provided on the crankshaft 17. The variation amount (angular velocity) of the rotational angle per unit time increases in proportion to the rotational speed Ne (actual number of rotations per unit time) of the engine 10. Accordingly, the engine speed sensor 35 has a function of acquiring the rotational speed Ne of the engine 10. It is to be noted that the engine controlling apparatus 1 may be configured otherwise such that it calculates the rotational speed Ne based on the rotational angle detected by the engine speed sensor 35.

An accelerator position sensor 36 for detecting an operation amount of the accelerator pedal (accelerator operation amount $A_{PS}$) and a brake fluid pressure sensor 37 for detecting a brake fluid pressure $B_{RK}$ corresponding to a brake operation amount are provided at arbitrary positions of the vehicle. The accelerator operation amount $A_{PS}$ is a parameter corresponding to an acceleration request or a starting will of the driver and is, in other words, a parameter correlative to a load to the engine 10 (output power request to the engine 10). Meanwhile, the brake fluid pressure B upon normal traveling of the vehicle is a parameter corresponding to a deceleration request or a stopping will of the driver.

The exhaust air-fuel ratio info/Elation and the information of the intake air flow rate Q, cooling water temperature $W_T$, rotational speed Ne, accelerator operation amount $A_{PS}$ and brake fluid pressure $B_{RK}$ acquired by the sensors 32 to 37 described above are transmitted to the engine controlling apparatus 1.

[1-4. Control System]

The engine controlling apparatus 1 (Engine Electronic Control Unit, control apparatus) is provided on the vehicle on which the engine 10 is incorporated. The engine controlling apparatus 1 is configured as an LSI (large scale integration) device or an embedded electronic device in which a microprocessor, a ROM (read only memory), a RAM (random access memory) and so forth are integrated, and is connected to a communication line of an in-vehicle network provided on the vehicle. It is to be noted that such various known electronic controlling apparatus as a brake controlling apparatus, a transmission controlling apparatus, a vehicle stabilization controlling apparatus, an air conditioning controlling apparatus and an electric component controlling apparatus are connected for communication to the in-vehicle network. The electronic controlling apparatus other than the engine controlling apparatus 1 are generally called external controlling system, and an apparatus controlled by the external controlling system is called external load apparatus.

The engine controlling apparatus 1 is an electronic controlling apparatus that comprehensively controls extensive systems such as an ignition system, a fuel system, intake and exhaust systems and a valve system relating to the engine 10, and controls the air amount and the purge gas amount to be supplied to each cylinder 19 of the engine 10, the fuel injection amount from the injector 18 and the ignition timing of each cylinder 19.

On the signal-input side of the engine controlling apparatus 1, the air-fuel ratio sensor 32, air flow sensor 33, cooling water temperature sensor 34, engine speed sensor 35, accelerator position sensor 36 and brake fluid pressure sensor 37 described above are connected. On the other hand, on the control-signal-output side of the engine controlling apparatus 1, the engine 10 is connected. The engine controlling apparatus 1 controls the air amount to be supplied to each cylinder 19 of the engine 10, fuel injection amount, ignition timing of each cylinder and so forth. Particular controlling targets of the engine controlling apparatus 1 are as follows in a example: the fuel amount, the injection timing of fuel to be injected from the injector 18, ignition timing by the ignition plug 13, opening of the throttle valve 23, purge valve 31 and so forth.

It is to be noted that the engine controlling apparatus 1 includes an opening controlling unit that calculate a target opening of the throttle valve 23 and the purge valve 31 and outputs control signals to the valves so that the actual valve opening may coincide with the target opening. The target openings of the valves calculated by the opening controlling unit correspond to openings $S_1$ and $S_2$. Accordingly, the engine controlling apparatus 1 has a function of detecting the openings $S_1$ and $S_2$ of the throttle valve 23 and the purge valve 31 of the controlling target.

[2. Control Configuration]

The air-fuel ratio control carried out by the engine controlling apparatus 1 is described. The air-fuel ratio of air-fuel mixture introduced into the cylinder 19 depends upon the opening $S_1$ of the throttle valve 23, opening $S_2$ of the purge valve 31, fuel injection amount from the injector 18 and purge gas concentration. Of the parameters, the openings $S_1$ and $S_2$ and the fuel injection amount are a controlling target of the engine controlling apparatus 1 and can be changed subjectively by the engine controlling apparatus 1 as desired.

On the other hand, the purge gas concentration is a parameter that varies depending upon the fuel evaporation rate from the fuel tank 28, elapsed time, pressure and temperature in the canister 29, performance of the activated carbon 29*a* and so forth, and cannot be changed subjectively by the engine controlling apparatus 1. Therefore, the engine controlling apparatus 1 changes the openings $S_1$ and $S_2$ and the fuel injection amount while estimating the value of the purge gas concentration from time to time to control the air-fuel ratio of the engine 10.

The fuel injection amount from the injector 18 is controlled principally by two techniques of feedback injection control and open loop injection control. The feedback injection control here is control with feedback which reflects a result of fuel injection upon setting of the target fuel injection amount, that is a cause of the fuel injection result. In the feedback injection control, the fuel injection amount from the injector 18 is adjusted based on exhaust air-fuel ratio information detected by the air-fuel ratio sensor 32. It is to be noted that, when the target value of the air-fuel ratio in the feedback injection control is a stoichimetric air-fuel ratio, the feedback injection control is also called stoichiometric feedback injection control.

In contrast, the open loop injection control is control which adjusts the fuel injection amount without using exhaust air-fuel ratio information detected by the air-fuel ratio sensor 32. That is, the open loop injection control is control without feedback. The open loop injection control is carried out, for example, when one of operating conditions listed below is satisfied. On the other hand, when none of the operating conditions is satisfied, the feedback injection control is carried out.

A: the elapsed time after the engine 10 is started is within a criterion period (predetermined period, certain period) of time.

B: the air-fuel ratio sensor 32 is in a cold state.

C: the cooling water temperature $W_T$ of the engine 10 is equal to or lower than a warm-up temperature.

In any of the controls described above, the engine controlling apparatus 1 calculates a target air-fuel ratio $AF_{TGT}$ in response to a load requested to the engine 10 and controls the fuel injection amount so that the air-fuel ratio of air-fuel mixture to be actually introduced into the cylinder 19 may become equal to the target air-fuel ratio $AF_{TGT}$.

As shown in FIG. 1, the engine controlling apparatus 1 includes an air-fuel ratio calculation unit 2, a purge rate calculation unit 3, a purge concentration calculation unit 4, a charging efficiency calculation unit 5, a decision unit 6, an inhibition period calculation unit 7 and a control unit 8. The components mentioned may be implemented by electronic circuitry (hardware) or by a program as software. Or else, some of the functions may be provided as hardware while the other functions are provided as software.

The air-fuel ratio calculation unit 2 calculates the air-fuel ratio of air-fuel mixture introduced into the cylinder 19. Here, an air-fuel ratio AF before exhaust gas burns is calculated based on exhaust air-fuel ratio information detected by the air-fuel ratio sensor 32. Information of the air-fuel ratio AF calculated by the air-fuel ratio calculation unit 2 is transmitted to the purge concentration calculation unit 4. The air-fuel ratio AF is hereinafter referred to as sensor air-fuel ratio AF. Further, for the distinction from the sensor air-fuel ratio AF, the air-fuel ratio of purge gas is referred to as purge gas air-fuel ratio $AF_{PRG}$.

The purge rate calculation unit 3 calculates a purge rate $R_{PRG}$ that corresponds to an introduction percentage of purge gas. In the present embodiment, the ratio of the purge gas flow rate from the purge valve 31 side to the intake air flow rate Q from the throttle valve 23 side is defined as purge rate $R_{PRG}$ (that is, $R_{PRG}$=(the purge gas flow rate)÷(intake air flow rate Q)). The value of the purge rate $R_{PRG}$ calculated by the purge rate calculation unit 3 is transmitted to the purge concentration calculation unit 4 and the decision unit 6.

The intake air flow rate Q from the throttle valve 23 side is calculated from the opening $S_1$ of the throttle valve 23 and the flow velocity. The flow velocity is calculated based on the intake air flow rate Q, pressures on the upstream and the downstream across the throttle valve 23, intake air temperature and so forth. Similarly, the purge gas flow rate is calculated from the opening $S_2$ of the purge valve 31 and the purge gas flow velocity. The purge gas flow velocity is calculated based on the pressures on the upstream and the downstream across the purge valve 31, pressure loss by the canister 29, intake air temperature and so forth. It is to be noted that a correction coefficient of a magnitude corresponding to a pressure difference or a pressure ratio (for example, a ratio of the downstream side pressure to the upstream side pressure) at the location of the throttle valve 23 may be set such that a value obtained by multiplying the ratio of the opening $S_2$ of the purge valve 31 to the opening $S_1$ of the throttle valve 23 by the correction coefficient is determined as the purge rate $R_{PRG}$.

The purge concentration calculation unit 4 calculates, based on the sensor air-fuel ratio AF calculated by the air-fuel ratio calculation unit 2 and the purge rate $R_{PRG}$ calculated by the purge rate calculation unit 3, a purge gas concentration estimated value $K_{AF_PRG}$ (value of an estimated concentration of purge gas) in accordance with a control signal transmitted thereto from the decision unit 6 hereinafter described. The purge concentration calculation unit 4 carries out, when calculation of the purge gas concentration estimated value $K_{AF_PRG}$ is permitted by the decision unit 6, the estimation calculation and updates the value of the purge gas concentration estimated value $K_{AF_PRG}$ to the latest value. On the other hand, when the calculation of the purge gas concentration estimated value $K_{AF_PRG}$ is inhibited by the decision unit 6, the value of the purge gas concentration estimated value $K_{AF_PRG}$ obtained in the last arithmetic operation cycle is maintained as it is.

The definition of the purge gas concentration estimated value $K_{AF_PRG}$ is a quotient when the target air-fuel ratio $AF_{TGT}$ is divided by the purge gas air-fuel ratio $AF_{PRG}$ and is a parameter corresponding to the fuel concentration of purge gas contained in exhaust gas from which the sensor air-fuel ratio AF is detected by the air-fuel ratio sensor 32.

For example, when the purge gas air-fuel ratio $AF_{PRG}$ is equal to the target air-fuel ratio $AF_{TGT}$, $K_{AF_PRG}=1.0$; when the purge gas air-fuel ratio $AF_{PRG}$ is richer (lower) than the target air-fuel ratio $AF_{TGT}$, $K_{AF_PRG}>1.0$; and when the purge gas air-fuel ratio $AF_{PRG}$ is leaner (higher) than the target air-fuel ratio $AF_{TGT}$, $K_{AF_PRG}<1.0$. When the target air-fuel ratio $AF_{TGT}$ is equal to a stoichimetric air-fuel ratio, the purge gas concentration estimated value $K_{AF_PRG}$ is a parameter corresponding to an equivalent ratio of purge gas.

The purge gas air-fuel ratio $AF_{PRG}$ can be calculated based on the sensor air-fuel ratio AF, purge rate $R_{PRG}$ and target air-fuel ratio $AF_{TGT}$. Accordingly, the purge gas concentration estimated value $K_{AF_PRG}$ is represented by a function of the sensor air-fuel ratio AF, purge rate $R_{PRG}$ and target air-fuel ratio $AF_{TGT}$ as given by the following expression 1.

$$K_{AF_PRG}=f_1(AF,R_{PRG},AF_{TGT}) \quad \text{(expression 1)}$$

The purge concentration calculation unit 4 in the present embodiment calculates a fuel amount correction coefficient $K_{FB_PRG}$ based on the target air-fuel ratio $AF_{TGT}$ and the sensor air-fuel ratio AF. The fuel amount correction coefficient $K_{FB_PRG}$ is an index value representative of by what amount the sensor air-fuel ratio AF is displaced from the target air-fuel ratio $AF_{TGT}$. Further, the purge concentration calculation unit 4 calculates a purge gas concentration estimated value $K_{AF_PRG}$ based on the fuel amount correction coefficient $K_{FB_PRG}$, purge rate $R_{PRG}$ and target air-fuel ratio $AF_{TGT}$ as given by the following expression 2. That is, the purge gas concentration estimated value $K_{AF_PRG}$ can be represented by expression 1 or expression 2.

$$K_{AF_PRG}=f_2(K_{FB_PRG},R_{PRG},AF_{TGT}) \quad \text{(expression 2)}$$

The fuel amount correction coefficient $K_{FB_PRG}$ is a parameter corresponding to a reciprocal number to the fuel concentration of exhaust gas of a detection target by the air-fuel ratio sensor 32. In other words, the fuel amount correction coefficient $K_{FB_PRG}$ is an index value for feeding back information of the sensor air-fuel ratio AF to later control and is, in feedback injection control, a coefficient that provides an amount of increase or decrease for bringing the sensor air-fuel ratio AF in a calculation cycle later than a next calculation cycle close to the target air-fuel ratio $AF_{TGT}$.

The fuel amount correction coefficient $K_{FB_PRG}$ is set to $K_{FB_PRG}=1.0$ when the sensor air-fuel ratio AF is equal to the target air-fuel ratio $AF_{TGT}$; to $K_{FB_PRG}<1.0$ when the sensor air-fuel ratio AF is richer (lower) than the target air-fuel ratio $AF_{TGT}$; and to $K_{FB_PRG}>1.0$ when the sensor air-fuel ratio AF is leaner (higher) than the target air-fuel ratio $AF_{TGT}$. When the target air-fuel ratio $AF_{TGT}$ is a stoichimetric air-fuel ratio, the fuel amount correction coefficient $K_{FB_PRG}$ is a parameter corresponding to an air excess ratio. The purge concentration calculation unit 4 calculates a purge gas concentration estimated value $K_{AF_PRG}$ based on the fuel amount correction coefficient $K_{AF_PRG}$, purge rate $R_{PRG}$ and target air-fuel ratio $AF_{TGT}$. Information of the purge gas concentration estimated value $K_{AF_PRG}$ calculated by the purge concentration calculation unit 4 is transmitted to the control unit 8.

It is to be noted that, the difference between the sensor air-fuel ratio AF and the target air-fuel ratio $AF_{TGT}$ includes a difference arising from introduction of purge gas and a difference caused by a factor other than the purge gas (an injection error from the injector 18, fuel-adhesion to the intake manifold 20, a detection error by the air-fuel ratio sensor 32 and so forth). Accordingly, a purge concentration correction coefficient $K_1$ for reducing the former difference to zero and an air-fuel ratio feedback correction coefficient $K_2$ for reducing the latter difference to zero may be calculated separately and then multiplied to determine the fuel amount correction coefficient $K_{FB_PRG}$.

In this instance, the purge concentration correction coefficient $K_1$ can be calculated, for example, based on the opening $S_2$ of the purge valve 31, purge rate $R_{PRG}$, purge gas concentration estimated value $K_{AF_PRG}$, sensor air-fuel ratio AF and so forth. Meanwhile, the air-fuel ratio feedback correction coefficient $K_2$ can be calculated, for example, based on the intake air flow rate Q, opening $S_1$ of the throttle valve 23, pressures on the upstream and the downstream across the throttle valve 23, intake air temperature and so forth.

FIG. 2 illustrates a relationship among the fuel amount correction coefficient $K_{FB_PRG}$, purge rate $R_{PRG}$ and purge gas concentration estimated value $K_{AF_PRG}$ as graphs. When the fuel amount correction coefficient $K_{FB_PRG}$ is 1.0, the purge gas concentration estimated value $K_{AF_PRG}$ is 1.0 irrespective of whether the purge rate $R_{PRG}$ is high or low (illustrated as a thick line). On the other hand, when the fuel amount correction coefficient $K_{FB_PRG}$ is lower than 1.0, the value of the purge gas concentration estimated value $K_{AF_PRG}$ increases in a substantially inverse relationship to the purge rate $R_{PRG}$ as the value of the purge rate $R_{PRG}$ decreases (illustrated as a thin line and a broken line). If the purge rate $R_{PRG}$ is fixed, then the value of the purge gas concentration estimated value $K_{AF_PRG}$ increases as the value of the fuel amount correction coefficient $K_{FB_PRG}$ decrease, and the gradient of the graph becomes steeper.

Similarly, when the fuel amount correction coefficient $K_{FB_PRG}$ is higher than 1.0, the value of the purge gas concentration estimated value $K_{AF_PRG}$ decreases in a substantially inverse proportion to the purge rate $R_{PRG}$ as the value of the purge rate $R_{PRG}$ decreases (illustrated as a alternate long and short dash line). If the purge rate $R_{PRG}$ is fixed, then the value of the purge gas concentration estimated value $K_{AF_PRG}$ decreases as the value of the fuel amount correction coefficient $K_{FB_PRG}$ increases and the gradient of the graph becomes steeper. However, the minimum value of the purge gas concentration estimated value $K_{AF_PRG}$ is 0.

The charging efficiency calculation unit 5 calculates a charging efficiency Ec based on the intake air flow rate Q detected by the air flow sensor 33. The charging efficiency Ec is a parameter corresponding to the amount of air actually introduced into the cylinder 19. The charging efficiency Ec is obtained by normalizing the volume of air charged into the cylinder 19 for a period of a single intake stroke into an air volume in a standard state (0° C., 1 atm) and then dividing the normalized air volume by the cylinder volume. Here, in regard to the cylinder 19 of the control target, the air amount actually taken into the cylinder 19 of the control target is calculated from the total amount of the intake air flow rate Q detected by the air flow sensor 33 for a period of time of the immediately preceding one intake stroke, and then the charging efficiency Ec is calculated. The charging efficiency Ec calculated by the charging efficiency calculation unit 5 is transmitted to the decision unit 6.

It is to be noted that the charging efficiency Ec obtained based on the intake air flow rate Q corresponds strictly to an air amount that is taken into the cylinder 19 after the point of the time of the calculation. Accordingly, in order to determine the air amount of exhaust gas when the exhaust gas from which the sensor air-fuel ratio AF has been detected by the air-fuel ratio sensor 32 is introduced into the cylinder 19, the charging efficiency Ec may be calculated based on the intake air flow rate Q at a point of time in the past with respect to the time of the detection by the air-fuel ratio sensor 32. Or, after the air amount is determined based on the latest intake air flow rate Q, calculation in which a certain intake response delay and an exhaust response delay are simulated may be carried out to determine the charging efficiency Ec regarding exhaust gas that arrives at the proximity of the air-fuel ratio sensor 32.

The decision unit 6 permits or inhibits calculation of the purge gas concentration estimated value $K_{AF_PRG}$ by the purge concentration calculation unit 4. The decision unit 6 first refers to such a characteristic of the purge gas concentration estimated value $K_{AF_PRG}$ as illustrated in FIG. 2 and inhibits, when the purge rate $R_{PRG}$ calculated by the purge rate calculation unit 3 is at least equal to or lower than a criterion rate $R_{TH}$, the calculation of the purge gas concentration estimated value $K_{AF_PRG}$. On the other hand, even if the purge rate $R_{PRG}$ exceeds the criterion rate $R_{TH}$, when the driving state is such that the variation amount of the fuel amount correction coefficient $K_{FB_PRG}$ calculated by the purge concentration calculation unit 4 per unit time is apt to become great (apt to fluctuate), the decision unit 6 inhibits the calculation of the purge gas concentration estimated value $K_{AF_PRG}$.

When one of conditions 1 to 4 listed below is satisfied, the decision unit 6 in the present embodiment inhibits the calculation of the purge gas concentration estimated value $K_{AF_PRG}$ and transmits a control signal to the purge concentration calculation unit 4 so that the value of the purge gas concentration estimated value $K_{AF_PRG}$ calculated in the last calculation period may be maintained.

Condition 1: the purge rate $R_{PRG}$ is lower than the criterion rate $R_{TH}$.

Condition 2: the engine 10 is in a sudden acceleration or deceleration state.

Condition 3: the engine 10 is in a low load state.

Condition 4: the open loop injection control is being carried out.

The "sudden acceleration or deceleration state" in the condition 2 signifies a state in which the rotational movement of the engine 10 is changing suddenly. The state includes a transient state in such transition operation that, for example, the rotational speed Ne (namely, the number of rotations per unit time and the speed of the engine 10) changes rapidly suddenly. Since the sudden acceleration or deceleration state is a state in which the target air-fuel ratio is apt to fluctuate, calculation of the purge gas concentration estimated value $K_{AF_PRG}$ is inhibited.

The condition 2 is decided, for example, based on the accelerator operation amount $A_{PS}$ detected by the accelerator position sensor 36 and a variation amount $\Delta A_{PS}$ of the accelerator operation amount $A_{PS}$ for a certain period of time. If the variation amount $\Delta A_{PS}$ of the accelerator operation amount $A_{PS}$ is higher than a criterion decision value on the positive side, then it is decided that "the engine is in a suddenly accelerating state". On the other hand, if the variation amount $\Delta A_{PS}$ is lower than the criterion decision value on the negative side, then it is decided that "the engine is in a suddenly decelerating state". It is to be noted that, in place of such a technique as just described, the variation amount $\Delta N_e$ of the rotational speed Ne (namely, an angular velocity of the engine 10) may be used to decide a suddenly accelerating state and a suddenly decelerating state.

The condition 3 is for determining whether or not the engine 10 is in a low load state when the load acting upon the engine 10 is equal to or lower than a criterion amount. The low load state includes a combustion limit state (limit state of flammability) in which the torque generated by the engine 10 is in the negative and so forth. Further, the magnitude of the load acting upon the engine 10 is calculated based on the rotational speed Ne of the engine 10, accelerator operation amount $A_{PS}$, operation state of the external load apparatus and so forth. It is to be noted that the condition 4 is for determining whether or not the driving state of the vehicle corresponds to one of the conditions A, B and C described hereinabove.

On the other hand, when all of the conditions 1 to 4 described above are unsatisfied and the following condition 5 is satisfied, the decision unit 6 permits the calculation of the purge gas concentration estimated value $K_{AF_PRG}$ and transmits a control signal to the purge concentration calculation unit 4 so that a new value of the purge gas concentration estimated value $K_{AF_PRG}$ is calculated and updated to the latest value in the current calculation cycle.

Condition 5: a criterion influence time period elapses after all of the conditions 1 to 4 become unsatisfied.

The condition 5 is a condition provided in order to reduce the calculation error of the purge gas concentration estimated value $K_{AF_PRG}$. For example, if the opening of purge valve 31 is released and the purge rate $R_{PRG}$ becomes equal to or higher than the criterion rate $R_{TH}$ while only the condition 1 is satisfied, all of the conditions 1 to 4 will be placed into an unsatisfied state. However, at this point of time, purge gas introduced into the intake system as a result of the release of the opening of the purge valve 31 does not arrive at the inside of the cylinder 19 and is not reflected on the sensor air-fuel ratio AF detected by the air-fuel ratio sensor 32 either. Therefore, even if the calculation of the purge gas concentration estimated value $K_{AF_PRG}$ is permitted immediately after all of the conditions of the 1 to 4 are placed into an unsatisfied state, it is difficult to assure calculation accuracy. Therefore, the decision unit 6 permits the calculation of the purge gas concentration estimated value $K_{AF_PRG}$ when the predetermined influence time period elapses after all of the conditions 1 to 4 are placed into an unsatisfied state.

The inhibition period calculation unit 7 carries out calculation relating to the criterion influence time period described above. The inhibition period calculation unit 7 calculates, based on the charging efficiency Ec calculated by the charging efficiency calculation unit 5, a period of delay time (namely, an influence time period of purge gas) required before purge gas passing the purge valve 31 comes to have an influence on the air-fuel ratio sensor 32.

This influence time period corresponds to a delay time period obtained by adding the intake response delay time period and the exhaust response delay time period of purge gas. The intake response delay time period is a period of delay time until purge gas passing the purge valve 31 is introduced into the cylinder 19. The intake response delay time period includes, for example, a time lag after the purge valve 31 is opened until an intake stroke is started and a delay time period provided by an influence of intake resistance or intake inertia. Meanwhile, the exhaust response delay time period is a period of delay time until exhaust gas after combustion arrives at the proximity of the air-fuel ratio sensor 32 after purge gas is introduced into the cylinder 19. The exhaust response delay time period includes, for example, a period of time delay required for a combustion cycle after an intake stroke till an exhaust stroke and a period of delay time by an influence of the exhaust resistance or exhaust inertia.

Here, it is assumed that the intake air amount that passes the throttle valve 23 and the fuel injection amount from the injector 18 are fixed (constant) and the air-fuel ratio when the purge valve 31 is closed is $AF_1$. Further, it is assumed that purge gas that is richer than the air-fuel ratio $AF_1$ exists in the purge passage 30. It is also assumed that the theoretical value (that is, opposite of an actual detected value) of the air-fuel ratio changes from $AF_1$ to $AF_2$ by opening the purge valve 31.

When the purge valve 31 is opened at time 0 in FIG. 3, the theoretical value of the air-fuel ratio varies like a staircase as indicated by a thick solid line in FIG. 3. Meanwhile, the purge gas passing the purge valve 31 does not enter the cylinder 19 immediately but arrives at the proximity of the air-fuel ratio sensor 32 after an intake response delay and an exhaust response delay as indicated by a thin solid line in FIG. 3. Therefore, the sensor air-fuel ratio AF gradually varies with a delay from time 0.

The influence time period of purge gas varies in response to the amount of air introduced into and exhausted from the cylinder 19 for every combustion cycle, that is, charging efficiency Ec. Variations of the sensor air-fuel ratio AF when the value of the charging efficiency Ec is $Ec_1$, $Ec_2$ and $Ec_3$ ($Ec_3<Ec_2<Ec_1$) are indicated by a thin solid line, a broken line and an alternate long and short dash line, in FIG. 3, respectively. As the charging efficiency Ec increases, a greater amount of purge gas arrives at the air-fuel ratio sensor 32 more rapidly, and the influence time is reduced. On the contrary, as the charging efficiency Ec decreases, the influence time period is elongated and the sensor air-fuel ratio AF becomes less likely to vary.

Here, $t_1$, $t_2$ and $t_3$ respectively represents response delay time periods until the sensor air-fuel ratio AF becomes a value $AF_3$ that is a little lower than the theoretical value $AF_2$ in regard to the cases where the value of the charging efficiency Ec are $Ec_1$, $Ec_2$ and $Ec_3$. The relationship in magnitude of these values is $t_1<t_2<t_3$. Therefore, the inhibition period calculation unit 7 carries out calculation of the influence time period of purge gas so that the influence time period decreases as the charging efficiency Ec increases but increases as the charging efficiency Ec decreases. It is to be noted that a particular set value of the value $AF_3$ may be determined arbitrarily, and an air-fuel ratio with which the delay response rate becomes equal to a criterion rate (for example, 80 to 99%).

For example as indicated in FIG. 4, values $IG_1$, $IG_2$ and $IG_3$ obtained by converting the response delay time periods $t_1$, $t_2$ and $t_3$ into stroke numbers of the engine 10 and reciprocal numbers $1/IG_1$, $1/IG_2$ and $1/IG_3$ to the values are determined in advance, and a relational expression or a map of the values is stored in advance. The inhibition period calculation unit 7 integrates a reciprocal number to a stroke number corresponding to the charging efficiency Ec from time to time and decides, when the integrated value becomes equal to or higher than 1.0, that the influence time period of purge pas has elapsed.

The control unit 8 controls the fuel injection amount from the injector 18 and the opening of the throttle valve 23 and the purge valve 31. The control unit 8 controls the opening of the throttle valve 23 and the purge valve 31, for example, based on the intake air flow rate Q, sensor air-fuel ratio AF, purge rate $R_{PRG}$, fuel amount correction coefficient $K_{FB_PRG}$, purge gas concentration estimated value $K_{AF_PRG}$ rotational speed Ne of the engine 10 and so forth. The fuel injection amount is carried out by one of the feedback injection control and the open loop injection control.

By such control as described above, when the engine 10 is in a driving state in which the purge gas concentration estimated value $K_{AF_PRG}$ is apt to vary by a great amount with respect to a variation of the fuel amount correction coefficient $K_{FB_PRG}$ or in another driving state in which the variation amount of the fuel amount correction coefficient $K_{FB_PRG}$ per unit time is apt to become great, the calculation of the purge gas concentration estimated value $K_{AF_PRG}$ is inhibited and the value in the last cycle is maintained. On the other hand, when the influence time period of purge gas elapses after such a driving state as described above is quitted, the calculation of the purge gas concentration estimated value $K_{AF_PRG}$ is permitted and the calculated value is updated to the latest value.

[3. Flow Chart]

Figure 5:
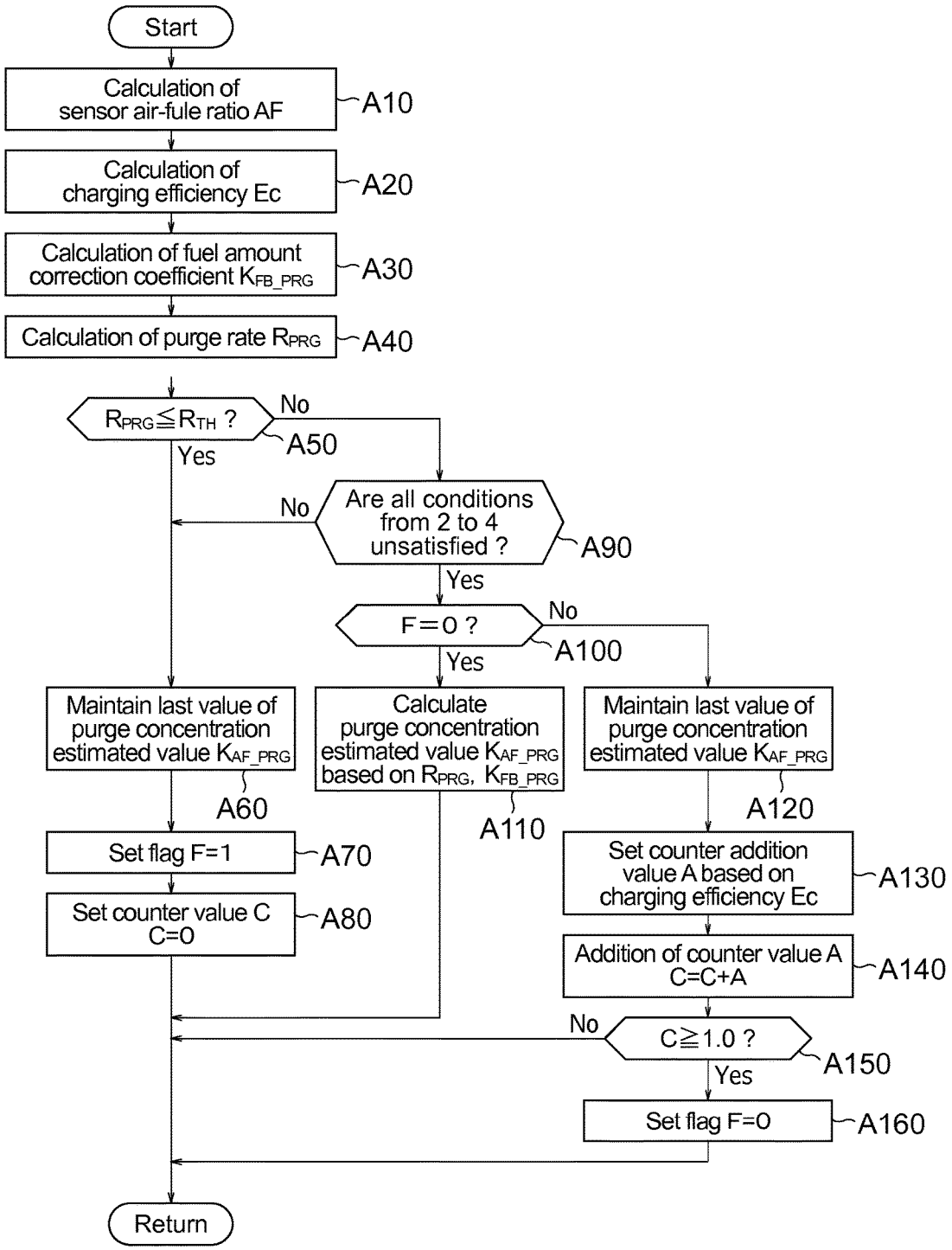
FIG. 5 is a flow chart exemplifying an estimation procedure of the purge gas concentration by the control apparatus.

FIG. 5 is a flow chart exemplifying a decision technique when calculation of the purge gas concentration estimated value $K_{AF_PRG}$ is permitted or inhibited in the engine controlling apparatus 1. This flow is carried out repetitively in a predetermined cycle set in advance (for example, in a cycle of several tens millisecond). The reference character F in the flow represents a flag representative of whether calculation of the purge gas concentration estimated value $K_{AF_PRG}$ is in a permitted state or in an inhibited state, and F=0 corresponds to the permitted state and F=1 corresponds to the inhibited state. Further, the reference character C represents a counter value (variable) for counting the influence time period of purge gas.

At step A10, exhaust air-fuel ratio information detected by the air-fuel ratio sensor 32 is inputted to the air-fuel ratio calculation unit 2 of the engine controlling apparatus 1, and a sensor air-fuel ratio AF is calculated by the air-fuel ratio calculation unit 2. At step A20, information of an intake air flow rate Q detected by the air flow sensor 33 is inputted to the charging efficiency calculation unit 5, by which a charging efficiency Ec is calculated.

At step A30, the purge concentration calculation unit 4 calculates a fuel amount correction coefficient $K_{FB_PRG}$ based on a target air-fuel ratio $AF_{TGT}$ and the sensor air-fuel ratio AF. It is to be noted that, where the purge gas concentration estimated value $K_{AF_PRG}$ is calculated based on the expression 1 given hereinabove, the step A30 may be omitted.

At step A40, an opening $S_1$ of the throttle valve 23, an opening $S_2$ of the purge valve 31, information of flow rates and so forth are inputted to the purge rate calculation unit 3, by which a purge rate $R_{PRG}$ is calculated based on the inputted information. For example, a value obtained by multiplying a rate of the opening $S_2$ of the purge valve 31 to the opening $S_1$ of the throttle valve 23 by a correction coefficient is calculated as the purge rate $R_{PRG}$. In this instance, the correction coefficient may be set taking pressure loss of air passing through the canister 29 into consideration, or a correction coefficient of a magnitude in accordance with a pressure difference or a pressure ratio (for example, a ratio of the downstream pressure to the upstream pressure) across the throttle valve 23 may be set.

Then at step A50, the decision unit 6 decides whether or not the purge rate $R_{PRG}$ calculated at the preceding step is equal to or lower than a criterion rate $R_{TH}$ (condition 1 given hereinabove). Here, if $R_{PRG} \leq R_{TH}$, then the decision unit 6 decides that the calculation error of the purge gas concentration estimated value $K_{AF_PRG}$ increases even if the sensor air-fuel ratio AF varies only a little and advances the processing to step A60. On the other hand, if $R_{PRG} > R_{TH}$, then the decision unit 6 decides that the calculation error of the purge gas concentration estimated value $K_{AF_PRG}$ with respect to the variation of the sensor air-fuel ratio AF is small and advances the processing to step A90.

At step A60, the decision unit 6 transmits a control signal to the purge concentration calculation unit 4 so that calculation of the purge gas concentration estimated value $K_{AF_PRG}$ is inhibited and a value of the purge gas concentration estimated value $K_{AF_PRG}$ calculated in the last calculation cycle is maintained. Then at step A70, the flag F is set to F=1, and then at step A80, the counter value C is set to C=0. Then, the control in the present calculation cycle ends therewith.

On the other hand, at step A90, the decision unit 6 decides whether or not at least one of the conditions 2 to 4 given hereinabove is satisfied. If one of the conditions that the engine 10 is in a suddenly accelerating or decelerating state, that the engine 10 is in a low load state and that the open loop injection control is being carried out, is satisfied at step A90, then the decision unit 6 decides that the fuel amount correction coefficient $K_{FB_PRG}$ is apt to vary. Thus, the processing advances to step A60, at which calculation of the purge gas concentration estimated value $K_{AF_PRG}$ is inhibited. On the other hand, if all of the conditions 2 to 4 given above are unsatisfied, then the decision unit 6 decides that the fuel amount correction coefficient $K_{FB_PRG}$ is not apt to vary, and the processing advances to step A100.

At step A100, it is decided whether or not the flag F is F=0. As described hereinabove, the flag F is set to F=1 when one of the conditions 1 to 4 is satisfied. On the other hand, the value of the flag F is set back to F=0 when all of the conditions 1 to 4 are unsatisfied and besides the condition 5 is satisfied. In other words, even if all of the conditions 1 to 4 are unsatisfied, calculation of the purge gas concentration estimated value $K_{AF_PRG}$ is not necessarily permitted. Therefore, at step A100, the state of the flag F is confirmed to decide whether or not the influence time period of purge gas has elapsed.

If the flag F is F=0 at step A100, then it is decided that the influence time period of purge gas has elapsed already, and the processing advances to step A110. At step A110, the purge concentration calculation unit 4 calculates a purge gas concentration estimated value $K_{AF_PRG}$ based on the fuel amount correction coefficient $K_{FB_PRG}$, purge rate $R_{PRG}$ and target air-fuel ratio $AF_{TGT}$ and updates the calculated value to the value of the latest value. Then, the control in the present calculation cycle ends therewith. In this manner, the purge gas concentration estimated value $K_{AF_PRG}$ is calculated after a point of time at which the influence time period of purge gas elapses after all of the conditions 1 to 4 become unsatisfied.

On the other hand, if the flag F is F=1 at step A100, then it is decided that the influence time period of purge gas has not elapsed as yet, and the processing advances to step A120. At step A120, calculation of the purge gas concentration estimated value $K_{AF_PRG}$ is inhibited and the last cycle value of the purge gas concentration estimated value $K_{AF_PRG}$ is maintained similarly as at step A60.

Then at step A130, the inhibition period calculation unit 7 sets a counter increment value A of a magnitude corresponding to the charging efficiency Ec. This counter increment value A has a value which increases as the charging efficiency Ec increases. The inhibition period calculation unit 7 sets a reciprocal to a stroke number corresponding to the charging efficiency Ec as the counter increment value A, for example, based on such a map as depicted in FIG. 4.

At step A140, a value C+A is substituted into the counter value C to integrate the counter value C. The sum of the counter increment value A and the counter value C in the last calculation cycle becomes the counter value C in the present calculation cycle. At next step A150, it is decided whether or not the counter value C is equal to or higher than a decision value (here 1.0).

If the decision result indicates C<1.0 at step A150, then it is decided that the influence time period of purge gas has not elapsed as yet, and the control in the present calculation cycle is ended. In this instance, before the influence time period of purge gas elapses, the flag F remains F=1, and calculation of the purge gas concentration estimated value $K_{AF_PRG}$ continues to be inhibited. It is to be noted that, if any of the conditions 1 to 4 becomes satisfied before the influence time period of purge gas elapses, since the counter value C is set back to C=0 at step A80, the influence time period of purge gas begins to be measured anew.

On the other hand, if the decision result at step A150 is C≥1.0, then it is decided that the influence time period of purge gas has elapsed, and the processing advances to step A160. At step A160, the flag F is set to F=0, and the control in the present calculation cycle is ended therewith. In this instance, if the conditions 1 to 4 are unsatisfied also in a next calculation cycle, then the processing advances to step A110, at which calculation of the purge gas concentration estimated value $K_{AF_PRG}$ is permitted.

[4. Working]

Figure 6A:
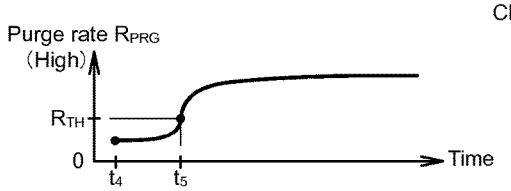
FIG. 6A is a graph illustrating contents of control by the control apparatus and depicting the purge rate.

A difference in working when measurement of the influence time period of purge gas within the control by the engine controlling apparatus 1 described hereinabove is compared with that of a conventional measurement method is described with reference to FIGS. 6A to 6E. As depicted in FIG. 6A, the purge ratio $R_{PRG}$ at time $t_4$ is equal to or lower than the predetermined ratio $R_{TH}$ and the condition 1 is satisfied. Therefore, calculation of the purge gas concentration estimated value $K_{AF_PRG}$ is inhibited. If the purge ratio $R_{PRG}$ increases until it exceeds the predetermined ratio $R_{TH}$ at later time $t_5$, then the condition 1 becomes unsatisfied. At this time, if also the conditions 2 to 4 are unsatisfied, then an influence time period of purge gas is calculated by the inhibition period calculation section 7. For example, in the engine controlling apparatus 1 described above, a time period within which the integrated value of the reciprocal to the stroke number corresponding to the charging efficiency Ec is equal to or higher than the predetermined value is determined as the influence time period of purge gas.

Here, if the charging efficiency Ec is fixed and does not vary, then characteristics of the intake response delay and the exhaust response delay of purge gas do not vary. Accordingly, similarly as in the conventional measurement method, even if an influence time period of purge gas is set based on elapsed time from time $t_5$, measurement can be carried out with comparatively high accuracy. Further, as depicted in FIG. 6D, also it is possible to set a decision value $C_{TH}$ corresponding to the charging efficiency Ec to the counter value C that increases at a fixed rate to determine the time period to time $t_6$ at which the counter value C exceeds the decision value $C_{TH}$ as the influence time period of purge gas.

Figure 6B:
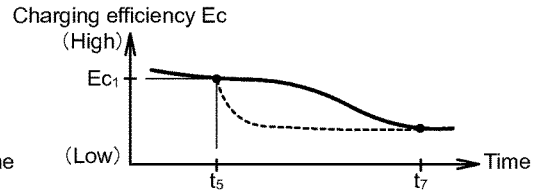
FIG. 6B is a graph illustrating contents of control by the control apparatus and depicting the charging efficiency.

On the other hand, if the charging efficiency Ec varies as indicated by a solid line in FIG. 6B, then since the characteristics of the intake response delay and exhaust response delay of the purge gas vary, the influence time period of purge gas cannot be set based on elapsed time from time $t_5$. Further, even if a decision value $C_{TH}$ corresponding to the charging efficiency Ec is set as indicated by a solid line in FIG. 6E, a technique of deciding whether or not the counter value C that increases at a fixed rate exceeds the decision value 1.0 fails to reflect an accurate influence time period of purge gas on a result of the decision. This is clear from the fact that there is the possibility that equal influence time period may be set also where a time-dependent variation curve of the charging efficiency Ec is varied so that intake air and exhaust air are less likely to pass as indicated by a broken line in FIGS. 6B and 6E.

Figure 6C:
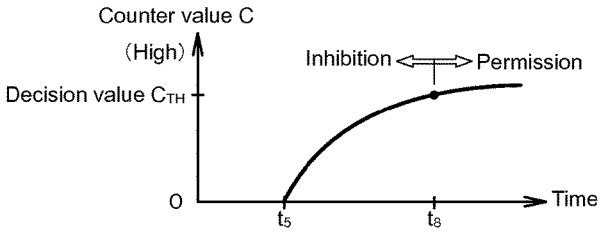
FIG. 6C is a graph illustrating contents of control by the control apparatus and depicting the counter value.
Figure 6D:
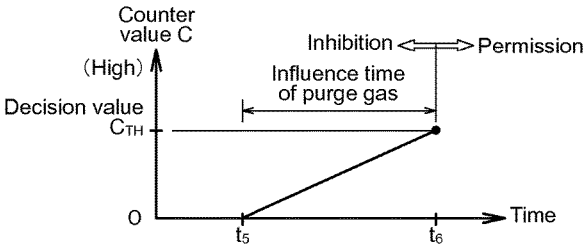
FIG. 6D is a graph depicting the counter value as a comparative example.
Figure 6E:
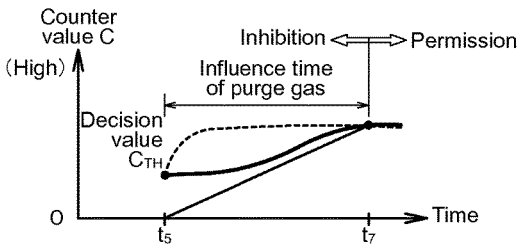
FIG. 6E is a graph depicting the counter value as another comparative example.
Figure 7:
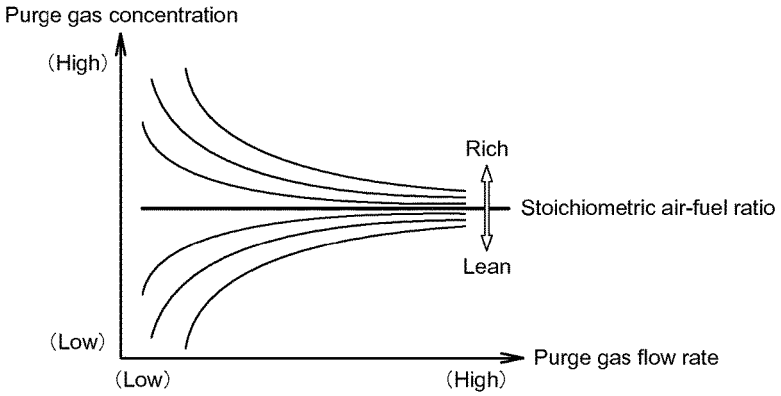
FIG. 7 is a graph exemplifying a relationship between the purge gas concentration and the flow rate.

On the other hand, in the engine controlling apparatus 1 described above, the incrementing amount of the counter value C is set to a magnitude in accordance with the charging efficiency Ec as depicted in FIG. 6C. Therefore, a history of the charging efficiency Ec is reflected on the counter value C. Consequently, if a state in which the charging efficiency Ec is high continues long, then the influence time period of purge gas is reduced. On the other hand, if another state in which the charging efficiency Ec is low continues for long time, then the influence time period of purge gas is extended.

For example, if the charging efficiency Ec varies as indicated by a solid line in FIG. 6B, then the increasing gradient of the counter value C is steep where the charging efficiency Ec is high, but the increasing gradient of the counter value C decreases as the charging efficiency Ec decreases. As depicted in FIG. 6C, time $t_8$ at which the counter value C exceeds the decision value $C_{TH}$ comes earlier than time $t_7$ depicted in FIG. 6E, and, when the response delay of the purge gas is cancelled, the calculation of the purge gas concentration estimated value $K_{AF_PRG}$ is re-started immediately.

[5. Effect]

In this manner, with the engine controlling apparatus 1 of the present embodiment, such workings and effects as described below are achieved.

(1) In the engine controlling apparatus 1 described above, it is decided based on the purge ratio $R_{PRG}$ whether or not calculation of the purge gas concentration estimated value $K_{AF_PRG}$ is to be carried out. Consequently, calculation in such a state that the calculation error of the purge gas concentration estimated value $K_{AF_PRG}$ increases in response to a very small variation of the sensor air-fuel ratio AF as depicted in FIG. 2 can be prevented. Further, the purge gas concentration estimated value $K_{AF_PRG}$ of high estimation accuracy can be determined. For example, even if a dispersion of the detection accuracy arising from an individual difference of the air-fuel ratio sensor 32 or a detection error by time-dependent deterioration appear, the estimation accuracy of the purge gas concentration estimated value $K_{AF_PRG}$ is less likely to degrade.

Further, as depicted in FIG. 2, the calculation error of the purge gas concentration estimated value $K_{AF_PRG}$ with respect to the purge ratio $R_{PRG}$ increases as the purge ratio $R_{PRG}$ decreases. In the engine controlling apparatus 1 described above, also the calculation in such a state as described above can be prevented and the purge gas concentration estimated value $K_{AF_PRG}$ of high estimation accuracy can be determined. For example, even if the calculation accuracy of the purge ratio $R_{PRG}$ is degraded by degradation of the detection accuracy of the opening $S_1$ of the air flow sensor 33, the opening $S_2$ of the purge valve 31 and so forth, the estimation accuracy of the purge gas concentration estimated value $K_{AF_PRG}$ is less likely to degrade.

Further, by controlling the fuel injection amount and the opening of the purge valve 31 using such purge gas concentration estimated value $K_{AF_PRG}$ of high accuracy as described above, the controlling characteristic of the air-fuel ratio can be improved.

(2) Further, in the engine controlling apparatus 1 described above, when calculation of the purge gas concentration estimated value $K_{AF_PRG}$ is permitted, the calculation is carried out, and the value of the purge gas concentration estimated value $K_{AF_PRG}$ is updated to the latest value. Consequently, the controlling accuracy of the air-fuel ratio can be enhanced. On the other hand, when calculation of the purge gas concentration estimated value $K_{AF_PRG}$ is inhibited, a value of the purge gas concentration estimated value $K_{AF_PRG}$ obtained in the last calculation cycle is maintained. In particular, even if calculation of the purge gas concentration estimated value $K_{AF_PRG}$ is inhibited, since an appropriate estimated value is retained, such a situation that the controlling characteristic of the air-fuel ratio degrades can be avoided while the influence of the calculation error is reduced.

(3) In the engine controlling apparatus 1 described above, the inhibition period of calculation of the purge gas concentration estimated value $K_{AF_PRG}$ is controlled based on the history of the charging efficiency Ec taking such a characteristic of the influence time period of purge gas as depicted in FIG. 3 into consideration. For example, if a state in which the charging efficiency Ec is high continues long, then the inhibition period of the calculation is shortened. And if a state in which the charging efficiency Ec is low continues long, then the inhibition period of the calculation is extended. Consequently, calculation of the purge gas concentration can be carried out avoiding a period within which a calculation error of the purge gas concentration estimated value $K_{AF_PRG}$ may possibly occur. Consequently, the controlling characteristic of the air-fuel ratio can be enhanced.

Further, a delay time period required until purge gas passing through the purge valve 31 comes to influence on the air-fuel ratio sensor 32 can be grasped with high accuracy by calculation based on the charging efficiency Ec. In other words, the earliest point of time at which purge gas passing through the purge valve 31 begins to influence on the air-fuel ratio sensor 32 can be grasped with high accuracy, and the calculation accuracy of the purge gas concentration estimated value $K_{AF_PRG}$ can be improved.

(4) It is to be noted that, upon sudden acceleration or deceleration of the engine 10, by a sudden variation of the load required for the engine 10, a difference is apt to appear between the target air-fuel ratio $AF_{TGT}$ and the sensor air-fuel ratio AF. And the variation of fuel amount correction coefficient $K_{FB_PRG}$ is apt to become great. In contrast, in the engine controlling apparatus 1 described above, not only when the purge rate $R_{PRG}$ is lower than the criterion rate $R_{TH}$ but also when the engine 10 is in a suddenly accelerating or decelerating state, calculation of the purge gas concentration estimated value $K_{AF_PRG}$ is inhibited. Accordingly, a purge gas concentration estimated value $K_{AF_PRG}$ that exhibits a great error is not calculated, and the controllability of the air-fuel ratio can be improved.

(5) Further, when the engine 10 is in a low load state (for example, when the engine 10 is in a combustion limit state in which the torque generated by the engine is in the negative), the combustion state is apt to become less stabilized, and part of combustion gas may be exhausted in an unburnt state. In this instance, the oxygen concentration in the exhaust gas becomes higher than the original concentration so as to cope with the amount of fuel components which have not been burnt. In other words, the sensor air-fuel ratio AF is outputted to the lean side with respect to the actual air-fuel ratio based on the fuel amount supplied into the cylinder 19, and consequently, a difference appears between the target air-fuel ratio $AF_{TGT}$ and the sensor air-fuel ratio AF. Accordingly, in a low load state of the engine 10, the variation of the fuel amount correction coefficient $K_{FB_PRG}$ is apt to become large.

In contrast, in the engine controlling apparatus 1 described above, also when the engine 10 is in a low load state, calculation of the purge gas concentration estimated value $K_{AF_PRG}$ is inhibited. Accordingly, such a situation that the calculation accuracy of the purge gas concentration estimated value $K_{AF_PRG}$ degrades does not occur, and the controllability of the air-fuel ratio can be improved.

It is to be noted that, in a state in which the conditions 2 and 3 described hereinabove are unsatisfied, the difference between the target air-fuel ratio $AF_{TGT}$ and the sensor air-fuel ratio AF is less apt to vary. Consequently, the fuel amount correction coefficient $K_{FB_PRG}$ is apt to be stabilized. Since calculation of the purge gas concentration estimated value $K_{AF_PRG}$ is carried out based on such a stabilized fuel amount correction coefficient $K_{FB_PRG}$, the calculation accuracy of the purge gas concentration estimated value $K_{AF_PRG}$ can be improved.

(6) Further, since the fuel injection amount is adjusted, while the open loop injection control is being carried out, without depending upon exhaust air-fuel ratio information detected by the air-fuel ratio sensor 32, a value of the sensor air-fuel ratio AF or a value of the fuel amount correction coefficient $K_{FB_PRG}$ may not be obtained. On the other hand, in the engine controlling apparatus 1, also when the open loop injection control is being carried out, calculation of the purge gas concentration estimated value $K_{AF_PRG}$ is inhibited. Accordingly, erroneous calculation of the purge gas concentration estimated value $K_{AF_PRG}$ can be prevented, and the controllability of the air-fuel ratio can be improved.

[6. Modifications]

Various modifications to the control carried out by the engine controlling apparatus 1 are expectable. For example, while, as the condition 1 described hereinabove, it is decided whether or not the purge rate $R_{PRG}$ is lower than the criterion rate $R_{TH}$, the value of the criterion rate $R_{TH}$ may be changed in response to the sensor air-fuel ratio AF or the fuel amount correction coefficient $K_{FB_PRG}$.

In this instance, as illustrated in FIG. 2, the value of the criterion rate $R_{TH}$ may be increased as the difference of the fuel amount correction coefficient $K_{FB_PRG}$ is spaced away from 1.0 (as the difference between the target air-fuel ratio $AF_{TGT}$ and the sensor air-fuel ratio AF increases). In other words, the value of the criterion rate $R_{TH}$ when the fuel amount correction coefficient $K_{FB_PRG}$ is $K_{FB_PRG3}$ may be set higher than the value of the criterion rate $R_{TH}$ when the fuel amount correction coefficient $K_{FB_PRG}$ is $K_{FB_PRG2}$ to expand the range of the purge rate $R_{PRG}$ within which calculation of the purge gas concentration estimated value $K_{AF_PRG}$ is inhibited (to make calculation of the purge gas concentration estimated value $K_{AF_PRG}$ more apt to be inhibited). By such setting, the suppression effect of a calculation error can be enhanced and the estimation accuracy of the purge gas concentration estimated value $K_{AF_PRG}$ can be improved.

Further, in the embodiment described above, when the influence time period of purge gas elapses after all of the conditions 1 to 4 become unsatisfied, calculation of the purge gas concentration estimated value $K_{AF_PRG}$ is permitted. On the other hand, the influence time period relating to the condition 1 is different from the influence time period relating to the conditions 2 to 4, and generally it is considered that the former influence timer period is longer than the latter influence time period. Therefore, a control configuration may be applied wherein, when all of the conditions 1 to 4 become unsatisfied, the length of the "predetermined influence time period" in the condition 5 is changed in response to the kind of that condition which has been satisfied till then.

By the control configuration, an accurate time period until an influence of a state variation relating to the conditions 1 to 4 is reflected on the sensor air-fuel ratio AF can be measured, and the period for which calculation of the purge gas concentration estimated value $K_{AF_PRG}$ is inhibited can be optimized. Accordingly, an accurate estimated value of the purge gas concentration estimated value $K_{AF_PRG}$ can be acquired rapidly.

Further, although the embodiment described above exemplifies a configuration that calculates an influence time period of purge gas using the charging efficiency Ec that is a parameter corresponding to the air amount, the charging efficiency Ec may be replaced by the amount of air (mass, volume) in a cylinder, a volumetric efficiency or the like. Any parameter can be applied similarly to the charging efficiency Ec at least if it correlates to the amount of air introduced into the cylinder 19 of the engine 10.

It is to be noted that the engine 10 in the embodiment described above may be of an arbitrary type, and a gasoline engine, a diesel engine and an engine of any other combustion type can be used.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

REFERENCE SIGNS LIST

1 engine controlling apparatus
2 air-fuel ratio calculation unit
3 purge rate calculation unit
4 purge concentration calculation unit
5 charging efficiency calculation unit
6 decision unit
7 inhibition period calculation unit
8 control unit
10 engine
23 throttle valve
31 purge valve
32 air-fuel ratio sensor
$K_{AF_PRG}$ purge gas concentration estimated value
$R_{PRG}$ purge rate
$K_{FB_PRG}$ fuel amount correction coefficient
AF air-fuel ratio (sensor air-fuel ratio)

The invention claimed is:

1. A control apparatus for an engine having a purge control valve that controls a flow rate of purge gas containing fuel gas evaporated from a fuel tank introduced into an intake system, comprising:

an air-fuel ratio calculation unit that calculates an air-fuel ratio (AF) of the engine;

a purge rate calculation unit that calculates a purge rate ($R_{PRG}$) corresponding to an introduction rate of the purge gas;

a concentration calculation unit that calculates a concentration ($K_{AF_PRG}$) of the purge gas based on the air-fuel ratio (AF) calculated by the air-fuel ratio calculation unit and the purge rate ($R_{PRG}$) calculated by the purge rate calculation unit;

a decision unit that permits or inhibits the concentration calculation unit to calculate the concentration ($K_{AF_PRG}$) based on the purge rate ($R_{PRG}$) calculated by the purge rate calculation unit;

an air amount calculation unit that calculates an air amount ($E_C$) to be introduced into a cylinder of the engine;

an inhibition period calculation unit that calculates a criterion influence time period for which the calculation of the concentration ($K_{AF_PRG}$) by the concentration calculation unit is inhibited based on the air amount ($E_C$) calculated by the air amount calculation unit, the criterion influence time period being set shorter as the air amount (Ec) is greater; and a control unit that controls the purge control valve based on the concentration ($K_{AF_PRG}$) such that the air-fuel ratio (AF) calculated by the air-fuel ratio calculation unit becomes a target air-fuel ratio, wherein the decision unit permits the concentration calculation unit to calculate the concentration ($K_{AF_PRG}$) only when the criterion influence time period elapses after predetermined driving conditions for permitting the calculation of the concentration ($K_{A_PRG}$) are met, and wherein the inhibition period calculation unit converts the criterion influence time period into a stroke number (IG) for every combustion cycle, the inhibition period calculation unit calculates a reciprocal number (1/IG) of the stroke number, the reciprocal number (1/IG) being defined as a fraction, a numerator of the fraction being set to 1 and a denominator of the fraction being set to the stroke number (IG), the inhibition period calculation unit calculates an integrated value (C) by adding the reciprocal number (1/IG) in every combustion cycle, and the inhibition period calculation unit decides that the criterion influence time period of the purge gas has elapsed when the integrated value (C) becomes equal to or higher than 1.0.

2. The control apparatus according to claim 1, wherein the decision unit allows the concentration calculation unit to update a calculation value of the concentration ($K_{AF_PRG}$) to the latest value when the purge rate ($R_{PRG}$) is equal to or higher than a criterion rate ($R_{TH}$); and the decision unit makes the concentration calculation unit maintain the last value of the concentration ($K_{AF_PRG}$) when the purge rate ($R_{PRG}$) is lower than the criterion rate ($R_{TH}$).

3. The control apparatus according to claim 1, wherein the decision unit permits or inhibits the calculation of the concentration ($K_{AF_PRG}$) to the concentration calculation unit based on a fuel amount correction coefficient ($K_{FB_PRG}$) correlative to a difference between the air-fuel ratio (AF) calculated by the air-fuel ratio calculation unit and a target air-fuel ratio.

4. The control apparatus according to claim 2, wherein the decision unit permits or inhibits the calculation of the concentration ($K_{AF_PRG}$) to the concentration calculation unit based on a fuel amount correction coefficient ($K_{FB_PRG}$) correlative to a difference between the air-fuel ratio (AF) calculated by the air-fuel ratio calculation unit and a target air-fuel ratio.

5. The control apparatus according to claim 3, wherein the decision unit inhibits the calculation of the concentration ($K_{AF_PRG}$) in a driving state in which the variation amount of the fuel amount correction coefficient ($K_{FB_PRG}$) is equal to or greater than a criterion amount, and permits the calculation of the concentration ($K_{AF_PRG}$) in another driving state in which the variation amount of the fuel amount correction coefficient ($K_{FB_PRG}$) is smaller than the criterion amount.

6. The control apparatus according to claim 4, wherein the decision unit inhibits the calculation of the concentration ($K_{AF_PRG}$) in a driving state in which the variation amount of the fuel amount correction coefficient ($K_{FB_PRG}$) is equal to or greater than a criterion amount, and permits the calculation of the concentration ($K_{AF_PRG}$) in another driving state in which the variation amount of the fuel amount correction coefficient ($K_{FB_PRG}$) is smaller than the criterion amount.

7. The control apparatus according to claim 1, wherein the decision unit inhibits the calculation of the concentration ($K_{AF_PRG}$) when, among the predetermined driving conditions, the engine is accelerated or decelerated suddenly, and permits the calculation of the concentration ($K_{AF_PRG}$) except a case in which the engine is accelerated or decelerated suddenly.

8. The control apparatus according to claim 1, wherein the decision unit inhibits the calculation of the concentration ($K_{AF_PRG}$) when, among the predetermined driving conditions, a load acting on the engine is equal to or lower than a criterion amount, and permits the calculation of the concentration ($K_{AF_PRG}$) when the load is higher than the criterion amount.

9. The control apparatus according to claim 1, wherein the decision unit permits the calculation of the concentration ($K_{AF_PRG}$) when, among the predetermined driving conditions, feedback injection control is being carried out, and inhibits the calculation of the concentration ($K_{AF_PRG}$) when open loop injection control is being carried out.

10. The control apparatus according to claim 1, wherein the decision unit changes a condition for permitting or inhibiting the calculation of the concentration ($K_{AF_PRG}$) in response to the air-fuel ratio (AF).

11. The control apparatus according to claim 1, further comprising:

an air-fuel ratio sensor disposed downstream from an exhaust manifold of the engine, wherein the criterion influence time period corresponds to a time required before the purge gas passing the purge control valve arrives at a proximity of the air-fuel ratio sensor.

* * * * *